United States Patent [19]

Jewell

[11] Patent Number: 4,671,005

[45] Date of Patent: Jun. 9, 1987

[54] TRIGGER MECHANISM

[75] Inventor: Arnold W. Jewell, 4201 Arroyo Dr., Midland, Tex. 79701

[73] Assignees: Arnold W. Jewell, Midland; James E. Goddard, Dripping Springs, both of Tex.

[21] Appl. No.: 733,617

[22] Filed: May 9, 1985

[51] Int. Cl.[4] ..... F41C 19/00; F41C 19/02

[52] U.S. Cl. ..... 42/69.02; 42/DIG. 1

[58] Field of Search ..... 42/69 R, 69 A, 69 B, 42/DIG. 1

[56] References Cited

U.S. PATENT DOCUMENTS

| | | | |
|---|---|---|---|
| 2,136,511 | 11/1938 | Jones | 42/DIG. 1 |
| 2,249,231 | 7/1941 | Smith | 42/69 A |
| 2,249,232 | 7/1941 | Smith | 42/69 A |
| 3,707,796 | 1/1973 | Bielfeldt | 42/69 A |

*Primary Examiner*—Deborah L. Kyle
*Assistant Examiner*—Ted L. Parr
*Attorney, Agent, or Firm*—Arnold, White & Durkee

[57] ABSTRACT

A trigger assembly for firearms which is externally adjustable to change trigger pull forces for both hunting and competition shooting, and which includes safety features for preventing inadvertant discharge. The trigger assembly is particularly adaptable for use with Mauser-type, bolt-action firearms and includes an over-center linkage mechanism which is geometrically adjustable to vary the pull force of the trigger piece. The over-center linkage mechanism includes a rotatable lever operably connected to the trigger piece, and a collapsible block pivotally coupled to the lever. The block and lever are alignable in supporting relation to the striker locking arm, which in turn holds the striker cocked. The relative alignment of the block and lever determines the amount of trigger pull forces required with the linkage mechanism in supporting engagement with the striker lock arm. Trigger piece movement effects rotation of the lever, pivotal collapse of the block and corresponding movement of the striker lock arm. A safety mechanism is provided to prevent unintentional pivotal collapse of the block.

17 Claims, 6 Drawing Figures

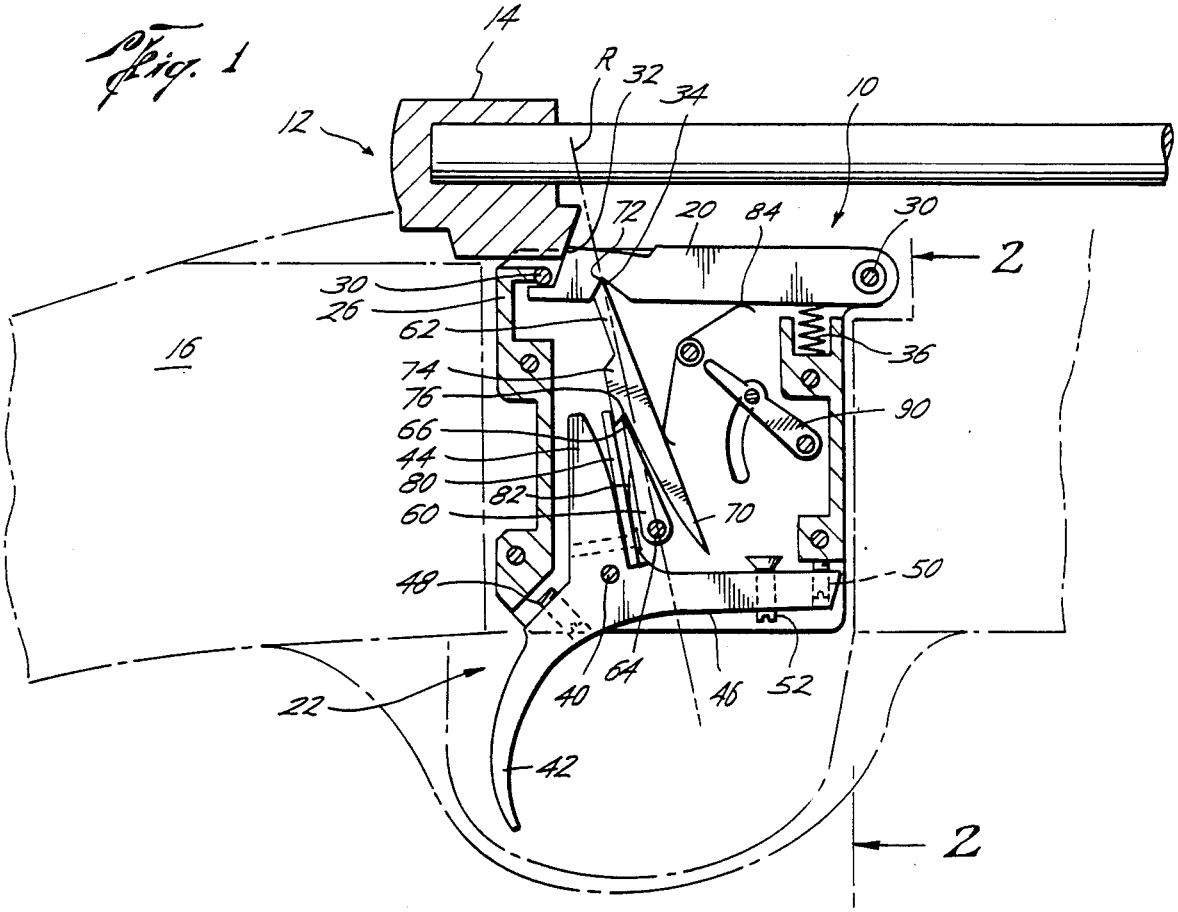
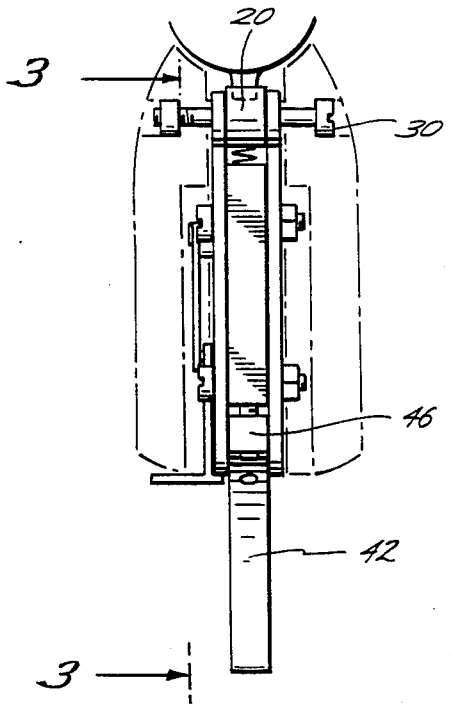
Fig. 2

TRIGGER MECHANISM

BACKGROUND OF THE INVENTION

1. Field of the Invention

This invention relates to a trigger assembly for firearms which is easily adjustable for military, hunting, and competition shooting and which is both safe and efficient in operation.

2. Description of the Prior Art

Over the past several centuries, a variety of trigger mechanisms have been devised for many different types of firearms and for different applications. Typically in military and hunting applications, trigger mechanisms are designed with emphasis on durability and reliability; consequently, such trigger mechanisms often have heavy trigger pull forces associated with firing the weapon. However, a heavy trigger pull forces degrades consistent accuracy and is particularly undesirable in competition shooting. Heavy trigger pull forces can result in instability of the firearm and also can fractionally delay discharge from the instant desired. It is necessary, of course, to have some trigger pull force to give the shooter feel and control of the firing process.

Those skilled in the art will appreciate that the desired trigger pull force is dependent upon type of firearm, application, and individual preference. An individual shooter might desire a medium to heavy trigger pull force when hunting, and a somewhat light trigger pull force for competition shooting. Further, a competition shooter might have a personal preference for a trigger pull force from two to twenty ounces.

There are, of course, many additional trigger characteristics which must be considered. For example, creep, overtravel, retraction, sensitivity, lock time, and vibration are all important considerations. However, safety is perhaps as important a consideration as pull force of the trigger. Typically, the safety mechanisms are more dependable in triggers having heavy pull forces, while the safety mechanisms associated with light pull force triggers, such as competition triggers, are often unreliable.

For example, in typical Mauser-type bolt-action rifles, a striker or cocking piece is held in the cocked position by a sear, with the sear in turn supported by a trigger piece. The metal surface interface between the cocking piece and sear carries the main spring load. Of course, there is a large frictional force associated between the meeting of these two metal surfaces. Typical adjustments to the trigger to lighten or vary the trigger pull force include adjusting the trigger spring or reducing to a minimum the mating surface area of the joinder between the cocking piece and the sear.

Another method of reducing trigger pull force is the so-called "multiple-lever" approach. For example, in the Remington "2-ounce" trigger, a third lever is interposed between the trigger piece and the sear to reduce the contact load carried by the trigger piece. In this arrangement, the mating surface between the cocking piece and the sear carries the large (about 25 pounds) mainspring load, while the mating area between the cocking piece and third lever carries a substantially reduced load. Other multiple lever triggers have been devised, such as the Canjar trigger (U.S. Pat. No. 4,028,835) and the Anshutz trigger (U.S Pat. No. 3,950,876).

A major problem associated with multiple lever triggers is that they merely substitute multiple sliding or sear mating surfaces. Particularly where the engagement area of these sear mating surfaces is reduced to lighten trigger pull forces, excessive wear or rounding of the mating surfaces is the inevitable result. Such wear at the sear engagement surfaces results in non-repetitive, unreliable and unsafe trigger operation. This is a particularly critical problem when the trigger is not adjustable for wear.

Another difficulty with typical trigger mechanisms is that they are either not adjustable, or only adjustable over a narrow range of trigger pull forces.

Still another problem with past trigger assemblies is the provision for adequate safety mechanisms. Particularly where the sear mating surfaces have been minimized for light pull forces, inadvertent discharge can easily result from wear of the sear mating surfaces and jolts to the firearm.

Thus, it would be a significant advance in the art if a trigger assembly were devised which allowed for adjustment of trigger pull forces over a wide range to accommodate both hunting, military, and competition shooting. Further, it would be an advance if such a trigger assembly were adjustable to individual preference. Additionally, an adjustable trigger assembly having a reliable safety mechanism would be a significant improvement in the art.

SUMMARY OF THE INVENTION

The trigger assembly in accordance with the present invention generally solves the problems outlined above. That is, the trigger assembly hereof is easily adjustable over a wide range of trigger pull forces and incorporates a reliable safety mechanism to prevent inadvertent discharge regardless of the trigger adjustment. Further, the trigger assembly of the present invention does not primarily rely upon sear mating surfaces for operation; thus, wear is generally avoided leading to safer, more economical, and more reliable trigger operation. Advantageously, the trigger assembly hereof is externally adjustable allowing for adjustments to the trigger operation without removal of the trigger assembly from the firearm. Further, the present trigger design incorporates a safety mechanism which effectively prevents unintentional firearm discharge. The trigger assembly hereof is particularly adaptable for use in a Mauser, bolt-action rifle, it being understood that the trigger assembly can be easily modified for use with other types of firearms.

Generally speaking, a Mauser bolt-action rifle includes a cocking piece or striker interconnected to the firing pin mechanism. The trigger assembly hereof includes an arm lock mechanism adapted for retaining the striker in the cocked position, a pivotally mounted trigger piece, and a link mechanism interconnecting the trigger piece and arm lock mechanism. The link mechanism includes a rotatable lever operably coupled to the trigger piece and a block operably disposed between the lever and the arm lock mechanism. The lever has a rotation axis and a support shoulder; the block presents a lip structure for pivotally engaging the lever shoulder, and a bevel surface for pivotally engaging the arm lock mechanism. The block operates to support the arm lock mechanism in the striker retaining position when the lever shoulder is in general alignment with the linear relationship between the lever axis and block bevel. With the lever shoulder rotated from such general alignment past a certain amount (for example when the trigger piece is actuated), the block pivots about the lever shoulder releasing the arm lock mechanism, and in turn, releasing the striker for discharge of the fire arm.

Preferably, the arm lock mechanism has a cleft on one side for pivotally receiving the block bevel; similarly, the block presents a lip for pivotally receiving the lever support shoulder. The trigger piece includes a generally upstanding arm operably coupled to the lever. The trigger piece arm allows only a limited amount of rotation of the lever towards the arm. Rotation of the lever towards the arm defines a "safe" direction in that the link mechanism is maintained in its supporting relationship to the arm lock mechanism. Pivotal movement of the trigger piece effects rotation of the lever away from the arm - "fire" direction.

Normally, rotation of the lever in the fire direction effects collapse of the block as soon as the lever shoulder is rotated past general alignment with the linear relationship between the lever axis and block bevel. Collapse of the block allows release of the arm lock mechanism and release of the striker, allowing firearm discharge. In a preferred embodiment, the trigger piece includes a sear set screw which can be adjusted to contact the block with the lever shoulder rotated just slightly past the general alignment in the fire direction. Slight movement of the trigger piece disengages the block, allowing collapse of the block and release of the arm lock mechanism. This arrangement is adjustable and yields very light trigger pull forces for competition shooting.

Viewed in another manner, the rotatable lever is adapted to engage the collapsible block in supporting contact with the striker lock arm. Rotation of the lever by a certain amount allows collapse of the block and pivotal movement of the striker lock arm. Advantageously, a releasable safety means is included for retaining the block in supporting contact with the striker lock arm. Preferably, the safety means includes an elongated brace which is pivotally mounted for movement to a block engaging position.

BRIEF DESCRIPTION OF THE DRAWINGS

FIG. 1 is a sectional view of the trigger assembly hereof incorporated in a conventional bolt action firearm illustrated in phantom;

FIG. 2 is a front elevational view of the trigger assembly hereof taken along line 2—2 of FIG. 1;

DESCRIPTION OF THE PREFERRED EMBODIMENTS

Figure 3:
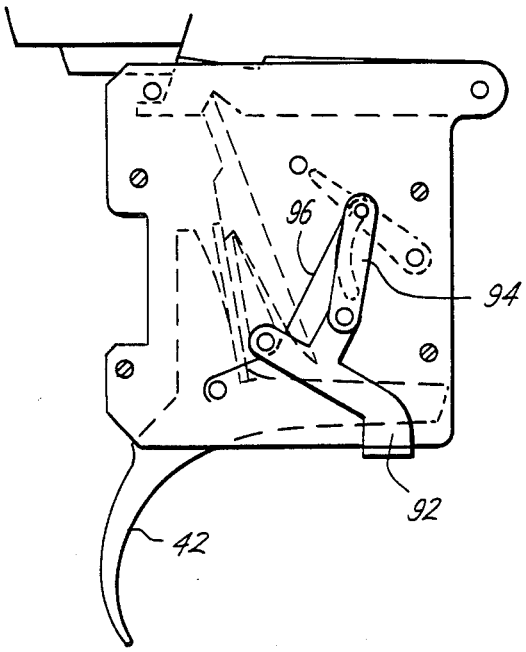
FIG. 3 is a side elevational view of the trigger assembly hereof, and particularly illustrates the firing position of the safety mechanism.

Turning now to the drawing, a trigger assembly 10 in accordance with the present invention is illustrated. FIGS. 1 and 2 show the trigger assembly 10 fitted into a rifle 12 of the Mauser, bolt-action type. Generally speaking, the rifle 12 includes a cocking piece or striker 14, a receiver and firing pin mechanism (not shown) and a stock 16.

In broad terms, the trigger assembly 10 includes arm lock means 20, trigger piece 22 and link mechanism 24 operably interconnecting the trigger piece 22 and arm lock means 20. The arm lock means 20 is pivotally mounted to a housing 26 on a sleeve about pin 30 and includes a striker piece engagement surface 32 on one side and a triangular in cross section cleft 34 on the other side. A spring 36 is coupled between the housing 26 and arm lock 20 near the pin 30 for upwardly biasing the arm lock 20.

The trigger piece 22 is pivotal about the pivot point 40 and includes a generally downwardly extending trigger shoe 42, a generally upstanding trigger arm 44 and an outwardly extending projection 46. An adjustable set screw 48 extends through the trigger shoe 42 towards a portion of the housing 26 and is adjustable to limit the amount of overtravel of the trigger piece 22. A set screw 50 extends through the projection 46 to abut a portion of the housing 26 and is adjustable to pivotally orient the trigger piece 22. Another set screw 52 extends through the projection 46 and has a beveled head to present a "sear" surface on the uppermost side of the projection 46.

The link mechanism 24 broadly includes a lever 60, operably coupled to the trigger piece 22 for rotation upon pivotal movement of the trigger piece 22, and block 62 disposed between the lever 60 and arm lock 20. The lever 60 has a rotation axis 64 which rotatably mounts the lever 60 to the housing 26, and a support shoulder 66 at one end. Preferably, the lever 60 is wedged shaped with the shoulder 66 presenting a convergent chamfered surface.

The block 62 is generally elongate and has a finger 70 at one end and a support bevel 72 at the other end. Further, the block 62 includes a centrally located abutment 74 and triangular lip 76. The lip 76 pivotally receives the lever shoulder 66, while the bevel 72 is pivotally received in the cleft 34. Block 62 is pivotally mounted between the lever 66, and arm lock 20, but is not directly coupled to the housing 26 in a "floating" type arrangement.

An elongated block position spring 80 is secured to the trigger piece arm 44 (as by the screw shown in phantom), the spring 80 extends upwardly to adjoin the abutment 74. Further, lever position spring 82 is secured to the trigger piece arm 44 and contacts the lever 60 as shown in the drawing. A link reset spring 84 is coupled to the housing 26 and contacts the arm lock 20 and block 62.

Figure 4:
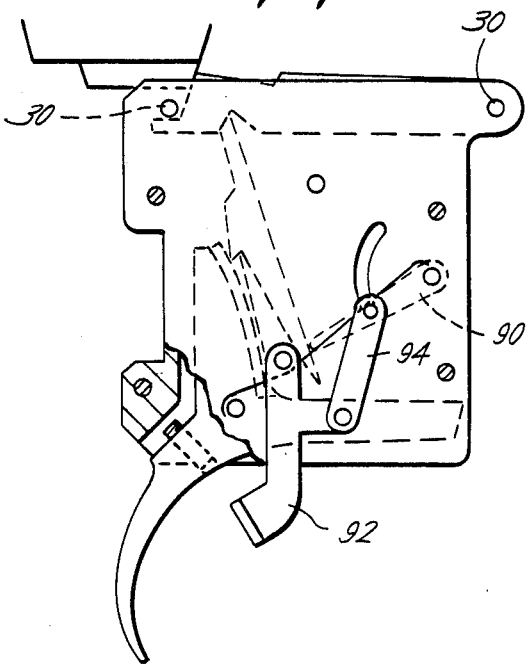
FIG. 4 is a side elevational view similar to FIG. 3 and particularly illustrates the blocking position of the safety mechanism hereof.

Turning particularly to FIGS. 3–4, a safety mechanism 28 includes an elongated, wedge-shaped brace 90 which is pivotally mounted to the housing 26 at one end and has a medially located guide pin received in a guide slot through the housing 26. Safety switch 92 is pivotally mounted to the outside of the housing 26 (FIGS. 2–4) and is connected to the guide pin of the brace 90 by the link 94. Spring 96 is provided as shown in FIGS. 3–4 to bias the safety mechanism 28 to the position shown in FIG. 4.

In the drawing, a reference line labeled R depicts the linear relationship between the rotation axis 64 of the lever 60 and the general region of the pivotal engagement of the bevel 72 in the cleft 34. The relationship of the contact of shoulder 66 in lip 76 to the line R is useful in understanding the operation of the trigger assembly 10. For clarity, rotation of the lever 60 from a position with shoulder 66 in general alignment with the line R towards the arm 44 (towards the left, or counterclockwise in the drawing) is denoted the "safe" direction. Rotation of the lever 60 towards the projection 46 (right, or clockwise in the drawing) is considered the "fire" direction.

In more detail, FIG. 1 generally illustrates the configuration of the trigger assembly 10 coupled in a Mauser, bolt-action type rifle. The trigger assembly 10 can easily be adapted for use in other types of firearms as well In FIG. 1, the rifle 12 is in the cocked position with the striker 14 retracted. The position set screw 5 has been adjusted in FIG. 1 to rotate the trigger piece 22 for a slightly heavy trigger pull force. The firearm main spring (not shown) applies pressure through the engagement surface 32 as a downward force on the arm lock 20. In FIG. 1 the arm lock 20 is supported by the lever 6 and block 62 counteracting this downward force. The support of arm lock 20 is provided by longitudinally wedging the block 62 between the lever 60 and the arm lock 20. The shoulder 66 is in an over-center condition in FIG. 1 in that a force is necessary to rotate shoulder 66 into alignment with line R before or during firing. The distance of shoulder 66 in the safe direction from line R (the amount of overcenter) determines the trigger pull force required. The orientation of the trigger piece 22, through the position springs 80, 82, permits the lever 60 and lock 62 to rotate in the safe direction. The configuration of FIG. 1 is a particularly safe condition in that any further downward pressure on the arm lock 20 (caused by bumps or jolts to the rifle 12) is transmitted through the link mechanism 24 to urge the lever 60 further in the safe direction. Thus, any jolts or bumps to the rifle 12 when configured as depicted in FIG. 1 urges the trigger assembly 10 to a more safe condition.

Figure 6:
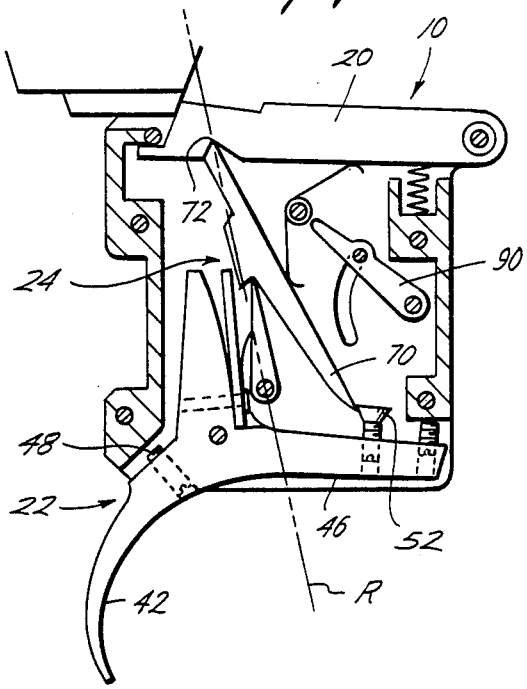
FIG. 6 is a vertical sectional view similar to FIG. 5 and depicts the trigger assembly in a very light trigger pull configuration.

Movement of the position set screw 50 pivots the trigger piece 22 and springs 80, 82 to reorient the lever shoulder 66 relative to the line R. This reorientation in turn adjusts the trigger pull forces. In theory, with the lever shoulder 66 in precise alignment with the line R, a very slight trigger pull force would cause rotation of the lever 60 in the fire direction. When a light trigger pull force is desired (for example for competition shooting) the trigger assembly 10 can be adjusted with the shoulder 66 on or near the line R, or the trigger assembly 10 can be adjusted to the position shown in FIG. 6. In FIG. 6, the sear screw 52 is upwardly adjusted and the position set screw 50 is adjusted to rotate the lever 60 in the fire direction. Collapse of the block 62 and discharge of the rifle 12 is prevented by the engagement of the finger 70 with the sear screw 52. As can be appreciated from FIG. 6, most of the main spring pressure is transmitted through the block 62 and lever 60, with only a small amount of force applied between the finger 70 and sear screw 52. However, even this small amount of force between the finger 70 and sear screw 52 can cause wear of the mating metal surfaces; the adjustability of the sear screw 52 easily compensates for minimal wear.

Figure 5:
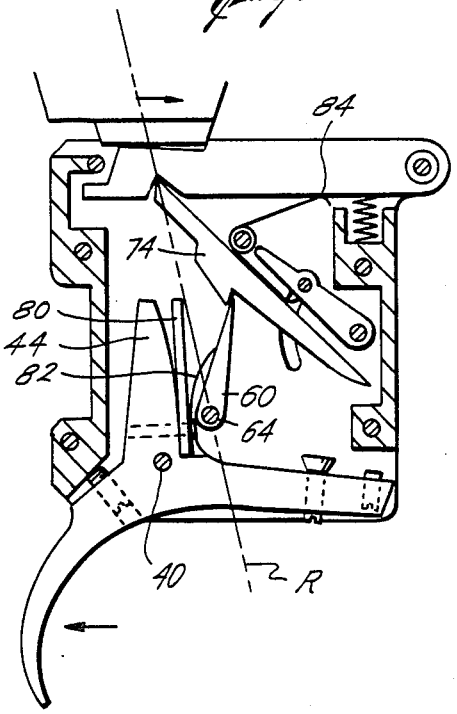
FIG. 5 is a vertical sectional view illustrating the trigger assembly after release of the striker.

In both FIGS. 1 and 6, the rifle 12 is in the cocked position and ready for firing. Pivotal movement of the trigger piece 22 rotates the arm 44 in the fire direction (clockwise) as well as the projection 46. In FIG. 1, rotation of the arm 44 effects rotation of the lever 60 and block 62 through the springs 80, 82. When the shoulder 66 of the lever 60 rotates past the line R in the fire direction, the shoulder 66 becomes "over-center" and further rotation quickly occurs. That is, the downward pressure by the arm lock 20 through the block 62 causes further rotation of the lever 60 to the configuration of FIG. 5. Upon rotation in the firing direction, the block 62 pivots about shoulder 66 while the bevel 72 pivots in the cleft 34. The collapse of the block 62 in FIG. 5 releases the arm lock 20 permitting release of the striker 14 and operation of the firing pin mechanism. The trigger assembly is reset after firing by moving the striker 14 rearwardly (in a bolt action firearm) to remove pressure from the lock arm 20. With the pressure removed from the lock arm 20, the springs 36, 84 cooperate to reset the link mechanism 24 and arm lock 20. The arm lock 20 has a tab at its distal end which contacts a portion of the housing 26 to limit the upward movement of the arm lock 20.

FIG. 6 presents a slight variation in that the shoulder 66 of the lever 60 is already rotated in the firing direction past the line R. Collapse of the block 62 is prevented by the contact between the finger 70 and sear screw 52. Slight movement of the trigger shoe 42 disengages the sear screw 52 from finger 70 allowing collapse of the block 62 and operation of the firearm. To reset the trigger assembly 10 after firing from the FIG. 6 configuration, the bolt is drawn removing downward pressure on arm lock 20. Springs 36, 84 bias lock arm 20 and link mechanism 24 towards the support position. During reset, finger 70 contacts sear screw 52 pivoting trigger piece 22. Trigger piece 22 then resets to the configuration of FIG. 6 under the bias of spring 82.

Turning to FIGS. 3–4, operation of the safety mechanism 28 is illustrated. In FIG. 4, the link mechanism 24 is positioned either as shown in FIGS. 1 or FIG. 6. The safety switch 92 is pivoted towards the trigger shoe 42 effecting corresponding pivotal movement the brace 90 into contacting engagement with the block 62. As illustrated in FIG. 4, depending upon the orientation of trigger piece 22 and link mechanism 24, contact of brace 90 can pivot the lever 60 and block 62 in the safe direction, compressing springs 80,82. Of course, the brace 90 is dimensioned to prevent collapse of the block 62 under almost any conditions.

To transition to a firing configuration, the safety switch 92 is pivoted forwardly away from trigger shoe 42 to the condition shown in FIG. 3. Forward pivoting of the safety switch 92 upwardly pivots the brace 90 out of a blocking position to the link mechanism 24 as shown in FIG. 3. The link mechanism 24 is allowed to travel to its present condition, for example FIGS. 1 or 6. With the brace 90 in a safe, blocking position, actuation of the trigger piece 22 does not damage any of the mechanical components of the trigger assembly 10. Instead, trigger shoe 42 travels backwardly until overtravel screw 48 contacts the adjacent portion of the housing 26. The brace 90 holds the link mechanism 24 in place; therefore the springs 80, 82 compress giving a "safe" trigger feel to the shooter. The bolt of the rifle 12 may be opened or closed with the safety mechanism 28 in either the safe or fire positions. However, the safety mechanism 28 cannot be "safed"—i.e. brace 90 rotated to contact block 62—once the rifle 12 is fired (see FIG. 5).

Another advantage of the trigger assembly 10 is readily apparent from the drawing and above description. That is, the trigger assembly 10 is easily adjustable without removal of the assembly 10 from the stock 16. Overtravel screw 48, position screw 50, and sear screw 52 are accessible externally for quick and easy adjustment of the trigger assembly 10.

Even if removal of the trigger assembly 10 is necessary (see FIGS. 1 and 2), removal of the pin 30 allows the entire trigger assembly to be quickly removed from the rifle 12. That is, a sleeve connects the lock arm 20 to the housing 26, the pin 30 passes through the sleeve to connect the housing 26 to the stock 16. The rear portion of the housing 26 is supporting in the stock by a lip. Thus, revoval of pin 30 allows removal of the entire trigger assembly 10.

I claim:

1. A trigger assembly for releasably engaging a striker or the like, comprising:

arm lock means adapted for pivotal movement between a striker retaining position and a striker release position;

a trigger piece pivotally mounted in spaced relationship to said arm means;

link mechanism operably interconnecting the trigger piece and arm lock means, including lever means operably coupled to said trigger piece for rotation upon pivotal movement of said trigger piece, the lever means having a rotation axis and a support shoulder, block means operably disposed between the lever means and the arm lock means, said block means having strucutre for pivotally engaging said lever shoulder and having a support bevel pivotally engaging said arm lock means, the block means being operable for supporting the arm lock means in the retaining position with the lever shoulder in general alignment with the linear relationship between the lever axis and block bevel, and the block means being pivotal about said lever shoulder for releasing the arm lock means when the lever shoulder is rotated from said general alginment past a certain amount; and sear means coupled to said trigger piece and adjustable for keeping the block means in supporting relation to the arm lock means when said lever shoulder is rotated in a firing direction from said linear relationship.

2. The trigger assembly in accordance with claim 1, including means for adjusting the alignment of the lever shoulder relative to said linear relationship.

3. The trigger assembly in accordance with claim 1, including stop means for preventing rotation of said lever shoulder past a certain amount in a safe direction from said linear relationship for keeping the block means in supporting relation to the arm lock means.

4. The trigger assembly in accordance with claim 1, said lock arm means including cleft structure pivotally receiving said block bevel.

5. The trigger assembly in accordance with claim 1, said block means including lip structure pivotally receiving said lever shoulder.

6. The trigger assembly in accordance with claim 1, including safety means for preventing movement of said block means from supporting engagement with said arm lock means.

7. The trigger assembly in accordance with claim 1, said trigger piece including a generally upstanding arm and means adjacent the upstanding arm for rotating said lever means.

8. The trigger assembly in accordance with claim 7 said lever rotating means comprising a spring operably disposed between the trigger piece arm and lever means.

9. The trigger assembly in accordance with claim 1, said block means including an abutment, the link mechanism including a bias member coupled to the trigger piece and adapted for contacting the abutment.

10. The trigger assembly in accordance with claim 1, the trigger piece having a generally outwardly extending projection and a pivot point.

11. The trigger assembly in accordance with claim 10 including means for adjusting the orientation of the trigger piece about said pivot point for effecting corresponding orientation of the lever means to adjust the alignment of the lever shoulder with said linear relationship.

12. The trigger assembly in accordance with claim 11, said trigger piece adjustment means including a set screw coupled to said projection for orienting the trigger piece.

13. The trigger assembly in accordance with claim 1, including spring means for biasing the block means towards the arm lock supporting position.

14. A trigger assembly for releasably engaging a striker or the like, comprising:

arm lock means adapted for pivotal movement between a striker retaining position and a striker release position;

a trigger piece pivotally mounted in spaced relationship to said arm lock means and including a generally upstanding arm and means adjaent the upstanding arm for rotating said lever means; and link mechanism operably interconnecting the trigger piece and arm lock means, including lever means having a rotation axis and a support shoulder, a spring operably disposed between the trigger piece upstanding arm and the lever means for rotating the lever means upon pivotal movement of said trigger piece, block means operably disposed between the lever means and the arm lock means, said block means having structure for pivotally engaging said lever shoulder and having a support bevel pivotally engaging said arm lock means, the block means being operable for supporting the arm lock means in the retaining position with the lever shoulder in general alignment with the linear relationship between the lever axis and block bevel, and the block means being pivotal about said lever shoulder for releasing the arm lock means when the lever shoulder is rotated from said general alignment past a certain amount.

15. A trigger assembly for releasably engaging a striker or the like, comprising:

arm lock means adapted for pivotal movement between a striker retaining position and a striker release position;

a trigger piece pivotally mounted in spaced relationship to said arm lock means and having a generally outwardly extending projection and a pivot point; and link mechanism operably interconnecting the trigger piece and arm lock means, including lever means operably coupled to said trigger piece for rotation upon pivotal movement of said trigger piece, the lever means having a rotation axis and a support shoulder, block means operably disposed between the lever measn and the arm lock means, said block means having structure for pivotally engaging said lever shoulder and having a support bevel pivotally engaging said arm lock means, the block means being operable for supporting the arm lock means in the retaining position with the lever shoulder in general alignment with the linear relationship between the lever axis and block bevel, the block means being pivotal about said lever shoulder for releasing the arm lock means when the lever shoulder is rotated from said general alignment past a certain amount, and the block means including a finger and said trigger piece projection including an upwardly extending sear means operable to contact said finger to prevent release of said arm lock means when the lever shoulder is rotated from said general alignment.

16. The trigger assembly in accordance with claim 15, said sear means comprising a set screw adjustable between a ginger contactable position and a retracted position.

17. A trigger linkage interposed between a trigger and an arm lock which is operable in two modes of operation, comprising:

a pivotally mounted lever having a rotation axis and a shoulder;

a block having a first pivot engaging the lever shoulder, a second pivot engaging the arm lock and a finger, the lever and block cooperative to support the arm lock with the rotation axis and pivot points in general alignment or with the first pivot rotated in a safe direction from said general alignment, in a first mode of operation, the trigger being operable to rotate the first pivot in a fire direction from said general alignjment to release the arm lock; and sear means coupled to the trigger, in a second mode of operation, the sear means being operable to engage said finger to prevent release of the arm lock with he first pivot rotated in the fire direction, actuation of the trigger effecting disengagement of the sear and finger to permit further rotation of the first pivot in the first directon and release of the arm lock.

* * * * *